US006630771B1

(12) United States Patent
Ulm et al.

(10) Patent No.: US 6,630,771 B1
(45) Date of Patent: Oct. 7, 2003

(54) SPARK PLUG ELECTRODE INCLUDING A PROFILED NOBLE-METAL PART

(75) Inventors: Heinz Ulm, Kunreuth (DE); Rainer Kocik, Bamberg (DE); Stephan Weigel, Thurnau (DE); Jochen Fischer, Bamberg (DE); Peter Metzler, Stegaurach (DE); Detlef Hartmann, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/763,510

(22) PCT Filed: Apr. 9, 1999

(86) PCT No.: PCT/DE99/01072

§ 371 (c)(1),
(2), (4) Date: Feb. 23, 2001

(87) PCT Pub. No.: WO00/13274

PCT Pub. Date: Mar. 9, 2000

(30) Foreign Application Priority Data

Aug. 25, 1998 (DE) ..... 198 38 538

(51) Int. Cl.[7] ..... H01T 13/22; H01T 21/02

(52) U.S. Cl. ..... 313/144; 313/141; 445/7

(58) Field of Search ..... 313/141, 142, 313/144, 136; 123/169 R, 169 EL; 445/7; 228/173.5

(56) References Cited

U.S. PATENT DOCUMENTS 5,456,624 A * 10/1995 Moore et al. ..... 219/93
5,856,724 A * 1/1999 Chiu et al. ..... 313/141
6,346,766 B1 * 2/2002 Kanao et al. ..... 313/141

FOREIGN PATENT DOCUMENTS

DE 3 727 526 3/1989
WO WO 95/25372 9/1995

* cited by examiner

*Primary Examiner*—Vip Patel
*Assistant Examiner*—Karabi Guharay
(74) *Attorney, Agent, or Firm*—Kenyon & Kenyon

(57) ABSTRACT

A spark plug electrode having a welded-on noble-metal part for a longer service life of the spark plug. Prior to the welding process, the noble-metal part is provided with a profiling on the side facing the spark plug electrode.

3 Claims, 2 Drawing Sheets

SPARK PLUG ELECTRODE INCLUDING A PROFILED NOBLE-METAL PART

FIELD OF THE INVENTION

The present invention relates to a spark plug electrode, at whose spark exit or spark entrance area a burn-resistant noble-metal is applied.

BACKGROUND INFORMATION

The use of nobel-metal platinum alloy results in a substantially longer service life of he electrodes, which are exposed to very great corrosion and erosion stresses in the combustion chamber because of the conditions prevailing there. For cost reasons, no provision has been made to date to produce the electrode of a spark plug completely from noble metal. However, varied possibilities have already been found to ennoble a spark plug electrode. German Patent No. 3 727 526 describes a method of producing a spark plug for internal combustion engines, in which a noble-metal platelet on the end face of the central or ground electrode is joined by laser welding to the material of the electrode.

The use of ennobled electrodes for a spark plug is always taken into consideration when one would like to achieve very long service live and longer maintenance intervals for a spark plug. In this connection, it is known to attach these noble-metal parts to the spark plug electrodes by laser welding and resistance welding. To compensate for different expansion coefficients, it is also conventional to provide a compensating layer between the electrode and the noble-metal part, to thus produce a better and more durable bond.

SUMMARY OF THE INVENTION

In accordance with the present invention, the use of a noble-metal part, which has a smooth surface on one side and a profiled surface on the other, for welding onto the spark plug electrode has the advantage that the profiled surface, because of the smaller contact area, exhibits a high transition resistance between the noble-metal part and the electrode during the welding process. The means a correspondingly high heat energy develops in the welding zone between the noble-metal part and the spark plug electrode. In turn, the provision of a smooth surface for the noble-metal part on the side facing the welding electrode has the advantage that a small transition resistance is present here, and less heat develops at this location than at the welding position. The present construction of the welded connection largely prevents a rupture and the corrosion of the welded connection between the noble-metal part and the electrode associated with such a rupture.

Profiling in the manner that, at the beginning of the welding process, the contact areas between the noble-metal part and the central electrode exist only in the edge area of the noble-metal part offers the advantage that the heating of the noble-metal part to be welded increases starting from the edge area toward the center, and because of the star-shaped structure, the air still present between the noble-metal part and the electrode can escape via radial channels. The welding temperature has a relatively uniform characteristic over the entire cross-section, and particularly in the critical edge area, can be brought to the desired high values. In this manner, the durability of the welded connection is substantially increased, which in turn influences the service life of the spark plug in a positive manner.

DETAILED DESCRIPTION

Figure 1:
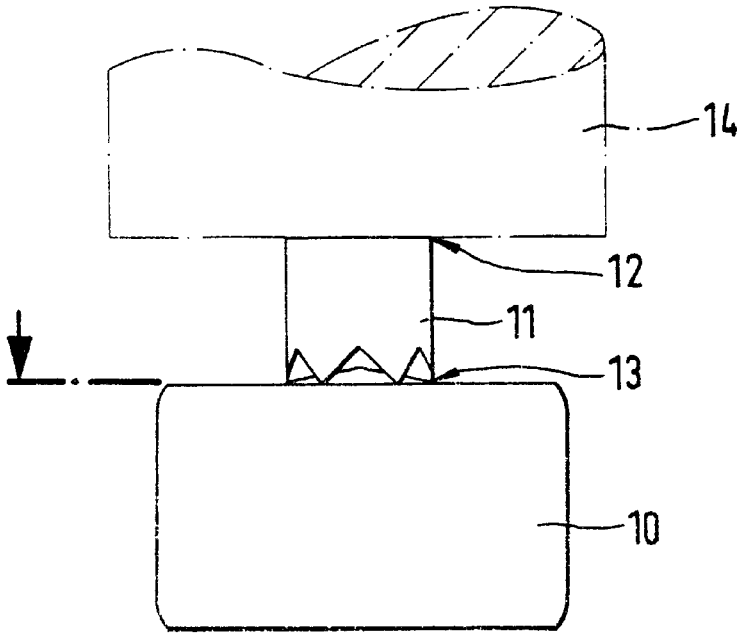
FIG. 1 shows a spark plug electrode and a noble-metal part of the present invention prior to welding.

FIG. 1 shows a spark plug electrode 10 and a noble-metal part 11 which is placed on the end face of spark plug electrode 10. This noble-metal part 11 has a smooth end face 12 and a profiled end face 13. Noble-metal part 11 is arranged in such a way that it rests with its profiled side 13 on spark plug electrode 10. Welding electrode 14 is shown schematically on the side of noble-metal part 11 having smooth surface 12 and facing away from spark plug electrode 10.

Figure 2:
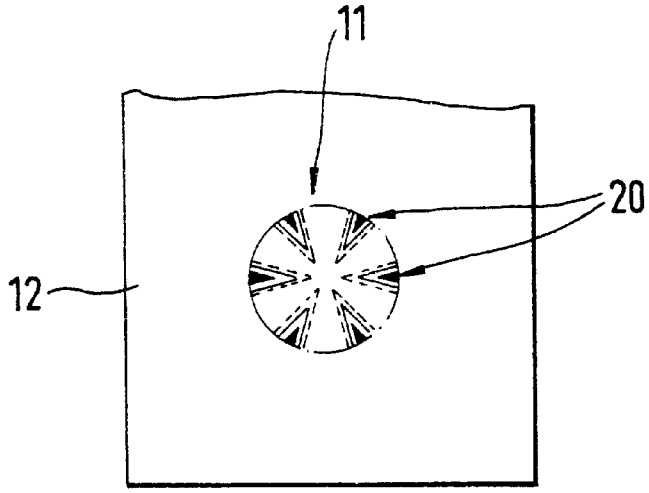
FIG. 2 shows a plain view of a profiled side of the noble-metal part.

FIG. 2 illustrates the design of profiled surface 13 of noble-metal part 11. In FIG. 2, components which have already been explained with respect to FIG. 1 are provided with the same reference numerals. Noble-metal part 11 is profiled in such a way that, between spark plug electrode 10 and noble-metal part 11, contact areas 20 are located at the outer edge of noble-metal part 11. As can be seen in FIG. 2, a star-shaped profiling was selected here which ensures that only the outer regions initially form a contact area 20 with spark plug electrode 10.

Figure 3A:
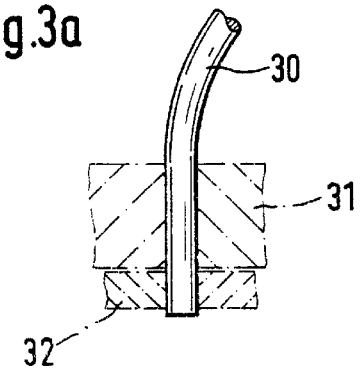
FIGS. 3*a*, 3*b*, 4*a*, 4*b*, 5*a* and 5*b* show individual method steps for producing the profiled noble-metal part and its welding to the spark plug electrode.
Figure 3B:
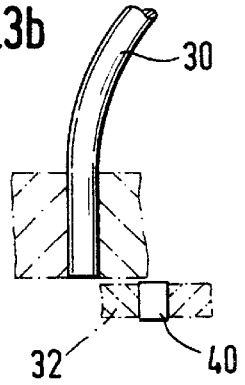
Figure 4A:
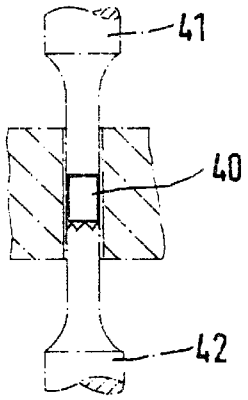
Figure 4B:
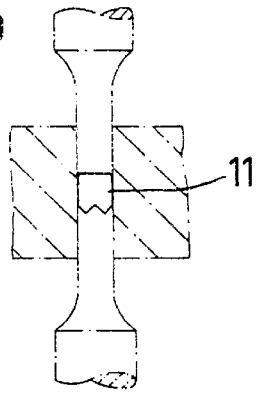
Figure 5A:
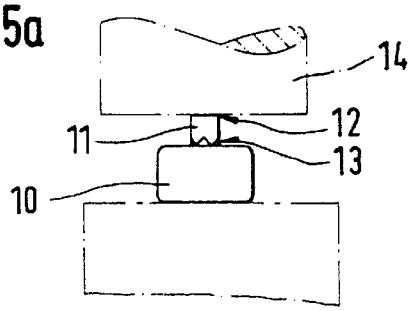
Figure 5B:
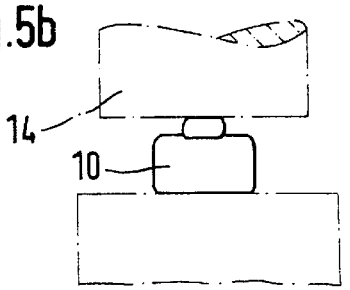

The production of the profiled noble-metal part according to the present invention and its welding to the central electrode shall now be clarified with reference to FIGS. 3*a* and 3*b*, FIGS. 4*a* and 4*b*, as well as FIGS. 5*a* and 5*b*. Since all the Figures relate to the same subject matter, the same reference numeral shall be used in each case for the same components, the reference numerals then not being completely explained again for the respective Figures.

In FIG. 3*a*, a noble-metal wire 30, e.g. a platinum wire, is guided through a retaining part 31, such that noble-metal wire 30 projects from this retainer 31 on the other side in a controlled manner. The length of the noble-metal part can be determined by a setting or else a preselection of the projection of the noble-metal part. The portion of noble-metal wire 30 projecting from retaining part 31 is now sheared off by a shearing tool 32. In FIG. 3*b*, a noble-metal cropping 40 has already been sheared off from noble-metal wire 30. Even given a relatively small wire diameter, it is possible to realize quite a great length of noble-metal cropping 40 using is this shearing method. The ratio of length to diameter of the noble-metal cropping is advantageously greater than 1.

In FIG. 4, noble-metal cropping 40 is disposed in an embossing die, between two stamps 41 and 42 and is compressed for enlarging the diameter, i.e., reducing the length. In this setting process, a first stamp 41 is provided with a smooth surface and a second stamp 42 is provided with a profiled surface. Because of this arrangement, noble-metal cropping 40 is embossed during the setting process shown in FIG. 4*b* into the form already explained with respect to FIG. 1, i.e., one surface has a smooth or even flat shape, and the opposite surface of noble-metal part 11 is profiled.

As shown in FIG. 5*a*, noble-metal part 11 thus formed is now mounted on spark plug electrode 10, e.g. a central electrode, in the manner that the side having smooth surface 12 faces welding electrode 14. Consequently, a good contact area with low transition resistance is present between noble-metal part 11 to be welded and welding electrode 14. Profiled end face 13 of noble-metal part 11 is arranged opposite the spark plug electrode, so that a high transition resistance, advantageous for the welding process, exists between the spark plug electrode and noble-metal part 11. The welding process itself may be carried out in two steps. In a first step, the profile tips are welded at contact areas 20 with a relatively low current intensity. In this manner, uniform starting conditions are produced for the second welding step. In the second welding step, the noble metal is welded with a higher current intensity up to the point of an all-over bond with the electrode.

FIG. 5*b* shows the bond between spark plug electrode 10 and noble metal part 11 after the welding process. This welded bond can now be fed to further processing steps. Thus, for example, given a use as central electrode, it is possible to shear off this bond in its edge area to ensure that, at the farthest, the noble-metal part reaches up to the opposite electrode of the spark plug.

The described method permits a largely free formation of the noble-metal part on the spark plug electrode.

In principle, widely varying profilings of the noble-metal part are conceivable. Possible. However, in each case the contact points between the noble-metal part and the electrode should be situated at the edge area of the noble-metal part. During heating, the necessary welding temperature is thus reached first at this location in the critical edge area, then spreads to the middle of the noble-metal part, and thus assures a good, planar welded connection and a cleanly welded edge area.

What is claimed is:

1. A method for producing a spark plug electrode arrangement, comprising:

shearing off a section of a noble-metal wire, the section forming a noble metal part;

arranging the noble-metal part in an embossing die and impressing two mutually opposite surfaces of the noble-metal part, a first surface being provided with a smooth surface, and a second surface opposite the first surface being provided with a profiled surface;

mounting the noble-metal part on the spark plug electrode so that the profiled surface of the noble-metal part faces the spark plug electrode, and the smooth surface of the noble-metal part faces away from the spark plug electrode; and welding the noble-metal part to the spark plug electrode, the profiled surface being formed so that at the beginning of the welding step, contact areas between the noble-metal part and the spark plug electrode are present only an outer edge area of the noble-metal part, the noble-metal part being welded at a spark exit or spark entrance area.

2. The method according to claim 1, wherein the welding step includes a two-step process, in a first step, profile tips of the profiled surface are welded at contact areas of the spark plug electrode with a low current intensity, and in a second step, the noble-metal part is welded with a higher current intensity up to a point of an all-over bond with the spark plug electrode.

3. A spark plug electrode arrangement, comprising:

a spark plug electrode having an end face; and a noble-metal part having a profiled surface and an outer edge area, the profiled surface including a plurality of contact areas situated at the outer edge area of the noble-metal part; wherein the noble-metal part is welded to the end face of the spark plug electrode at the plurality of contact areas, the noble-metal part being welded to the spark plug electrode at one of a spark plug exit area of the spark plug electrode and a spark entrance area of the spark plug electrode; and wherein the profiled surface of the noble-metal part includes at least one radial channel operable to permit air between the noble-metal part and the spark plug electrode to escape.

* * * * *

UNITED STATES PATENT AND TRADEMARK OFFICE

CERTIFICATE OF CORRECTION

PATENT NO. : 6,630,771 B1
DATED : October 7, 2003
INVENTOR(S) : Heinz Ulm et al.

It is certified that error appears in the above-identified patent and that said Letters Patent is hereby corrected as shown below:

Column 1,
Line 11, change “he” to -- the --
Line 25, change “known” to -- conventional --
Line 39, change “The means a” to -- This means a --
Line 20, change “are conceivable. Possible.” to -- are possible. --

Signed and Sealed this

Twelfth Day of October, 2004

JON W. DUDAS
*Director of the United States Patent and Trademark Office*